US009815664B2

(12) United States Patent
Zhang et al.

(10) Patent No.: US 9,815,664 B2
(45) Date of Patent: Nov. 14, 2017

(54) STRANGER PREVENTION FOR ELEVATOR DESTINATION ENTRY SYSTEM

(71) Applicant: Otis Elevator Company, Farmington, CT (US)

(72) Inventors: Jinglong Zhang, Shanghai (CN); Kensaku Yamane, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/185,862

(22) Filed: Jun. 17, 2016

(65) Prior Publication Data

US 2016/0368735 A1 Dec. 22, 2016

(30) Foreign Application Priority Data

Jun. 19, 2015 (CN) ..... 2015 1 0343553

(51) Int. Cl.
*B66B 1/16* (2006.01)
*B66B 5/00* (2006.01)
(Continued)

(52) U.S. Cl.
CPC ..... *B66B 5/0012* (2013.01); *B66B 1/2408* (2013.01); *B66B 1/468* (2013.01);
(Continued)

(58) Field of Classification Search
None
See application file for complete search history.

(56) References Cited

U.S. PATENT DOCUMENTS 4,030,572 A * 6/1977 Kaneko ..... B66B 1/2408 187/382
5,035,302 A * 7/1991 Thangavelu ..... B66B 1/2408 187/382
(Continued)

FOREIGN PATENT DOCUMENTS

AU 2012257871 A1 11/2013
CN 101774501 A1 7/2010
(Continued)

OTHER PUBLICATIONS

European Search Report for application EP 16175323.1, dated Nov. 14, 2016, 7 pages.

*Primary Examiner* — Joseph Feild
*Assistant Examiner* — John Mortell
(74) *Attorney, Agent, or Firm* — Cantor Colburn LLP

(57) ABSTRACT

An elevator taking user management system, which includes a detection apparatus, a processing module, and an output apparatus. The processing module is respectively electrically connected to the detection apparatus and the output apparatus. The detection apparatus detects the number of persons in an elevator waiting area; the processing module receives a signal at least indicating the detected number of persons sent by the detection apparatus, acquires the number of persons who have input target floors, further compares the detected number of persons with the number of persons who have input target floors at the floor where the detection apparatus is located, and when the detected number of persons is greater than the number of persons who have input target floors, sends a reminding signal; and the output apparatus is eclectically connected to the processing module, for receiving the reminding signal and presenting it in the elevator waiting area.

14 Claims, 1 Drawing Sheet

(51) Int. Cl.

| | |
|---|---|
| ***B66B 1/24*** | (2006.01) |
| ***B66B 1/46*** | (2006.01) |
| *B66B 3/00* | (2006.01) |

(52) U.S. Cl.

CPC ..... *B66B 3/00* (2013.01); *B66B 2201/103* (2013.01); *B66B 2201/222* (2013.01); *B66B 2201/4615* (2013.01)

(56) References Cited

U.S. PATENT DOCUMENTS

| | | | | |
|---|---|---|---|---|
| 5,298,697 | A * | 3/1994 | Suzuki | B66B 1/3476 187/380 |
| 6,707,374 | B1 | 3/2004 | Zaharia | |
| 6,794,986 | B2 | 9/2004 | Puchek et al. | |
| 7,140,469 | B2 | 11/2006 | Deplazes et al. | |
| 7,621,378 | B2 * | 11/2009 | Kawai | B66B 5/021 187/313 |
| 9,481,548 | B2 * | 11/2016 | Siddiqui | B66B 1/2416 |
| 2004/0017929 | A1 | 1/2004 | Bramblet et al. | |
| 2004/0188185 | A1 | 9/2004 | Pieper | |
| 2006/0037818 | A1 | 2/2006 | Deplazes et al. | |
| 2009/0057068 | A1 | 3/2009 | Lin et al. | |
| 2011/0168499 | A1 * | 7/2011 | Takeuchi | B66B 1/468 187/389 |
| 2011/0215932 | A1 | 9/2011 | Daniel | |
| 2013/0048435 | A1 | 2/2013 | Finschi | |
| 2013/0233653 | A1 | 9/2013 | Chen | |
| 2015/0068849 | A1 | 3/2015 | Haipus et al. | |
| 2015/0329316 | A1 * | 11/2015 | Lee | B66B 1/2408 187/384 |
| 2016/0130112 | A1 * | 5/2016 | Nikovski | B66B 1/2458 187/247 |

FOREIGN PATENT DOCUMENTS

| | | | |
|---|---|---|---|
| EP | 1930276 | A1 | 6/2008 |
| FR | 2844901 | A1 | 3/2004 |
| JP | 2012153454 | A | 8/2012 |
| WO | 2011012768 | A1 | 2/2011 |

* cited by examiner

STRANGER PREVENTION FOR ELEVATOR DESTINATION ENTRY SYSTEM

PRIORITY

This application claims priority to Chinese Patent Application No. 201510343553.1 filed Jun. 19, 2015, and all the benefits accruing therefrom under 35 U.S.C. §119, the contents of which in its entirety are herein incorporated by reference.

TECHNICAL FIELD

The present invention relates to technologies related to elevators, and in particular, to an elevator taking user management technology.

BACKGROUND ART

Methods for a user who is going to take an elevator to order and call an elevator are known in the field of elevators, for example, a target elevator floor is input by using an ordering terminal disposed on the floor, and the user may then wait for the elevator to come.

During the use of elevators, people pay considerable attention on an elevator security system. For example, US20130048435 discloses an elevator mounting access security method having position detection. A core thereof lies in detecting a position of an elevator user in a building area. If the number of elevator users arranged in an elevator cabin is, for example, inconsistent with the number of elevator users assigned to this elevator cabin, a security measure is triggered; and if positions of elevator users in an elevator cabin are inconsistent with positions of elevator users arousing destination calls or elevator calls, the security measure is also triggered.

Currently, in the field of elevators, people pay more attention to preventing or avoiding as much as possible unauthorized persons from entering places related to security, such as the elevator cabin.

SUMMARY OF THE INVENTION

The present invention provides an elevator taking user management system, which includes a detection apparatus, a processing module, and an output apparatus. The processing module is respectively electrically connected to the detection apparatus and the output apparatus. The detection apparatus detects the number of persons in an elevator waiting area; the processing module receives a signal at least indicating the detected number of persons sent by the detection apparatus, acquires the number of persons who have input target floors from a target floor transport system, further compares the detected number of persons with the number of persons who have input target floors in the floor where the detection apparatus is located, and when the detected number of persons is greater than the number of persons who have input target floors, sends a reminding signal; and the output apparatus is eclectically connected to the processing module, for receiving the reminding signal and presenting it at the elevator waiting area, so as to remind those who do not input target floors to input the target floors.

In the elevator taking user management system according to the present invention, optionally, the output apparatus is a display apparatus, which displays the reminding signal from the processing module in real time on the elevator waiting area being detected by the detection apparatus.

In the elevator taking user management system according to the present invention, optionally, the output apparatus is a voice prompt apparatus, which presents the reminding signal from the processing module in a voice manner on the elevator waiting area being detected by the detection apparatus.

In the elevator taking user management system according to the present invention, optionally, the detection apparatus is disposed in a hall of a building where the elevator is located.

In the elevator taking user management system according to the present invention, optionally, the detection apparatus is disposed respectively at every floor or some floors of elevator arrival floors.

In the elevator taking user management system according to the present invention, optionally, the output apparatus is disposed at the arrival floor provided with the detection apparatus in the elevator floors.

The present invention further provides an elevator system, which includes the elevator taking user management system as described in the foregoing.

The present invention further provides an elevator taking user management method, including: detecting, by a detection apparatus, the number of persons in an elevator waiting area; acquiring, by a target floor transport system of the elevator, the number of persons who have input target floors on a floor where the detection apparatus is located; and comparing the detected number of persons with the number of persons who have input target floors, and when the detected number of persons is greater than the number of persons who have input target floors, presenting reminding information at the elevator waiting area being detected by the detection apparatus, so as to remind those who do not input target floors to input target floors.

In the elevator taking user management method according to the present invention, optionally, the presenting the reminding information in the elevator waiting area is presenting the reminding signal from the processing module in real time in a displaying manner in the elevator waiting area being detected by the detection apparatus.

In the elevator taking user management method according to the present invention, optionally, the presenting the reminding information in the elevator waiting area is presenting the reminding signal from the processing module in a voice manner in the elevator waiting area being detected by the detection apparatus.

In the elevator taking user management method according to the present invention, optionally, the detection apparatus is disposed in a hall of a building where the elevator is located.

In the elevator taking user management method according to the present invention, optionally, the detection apparatus is disposed at every floor or some floors of elevator arrival floors.

In the elevator taking user management method according to the present invention, optionally, the output apparatus is disposed at the arrival floor provided with the detection apparatus in the elevator floors.

The present invention further provides an elevator management method, which includes the elevator taking user management method as described in the foregoing.

By using the elevator taking user management system of the present invention or executing the elevator taking user management method according to the present invention, more elevator waiting persons may be prompted to input target floors, thereby being conducive to accurately allocating the elevator.

DETAILED DESCRIPTION

Figure 1:
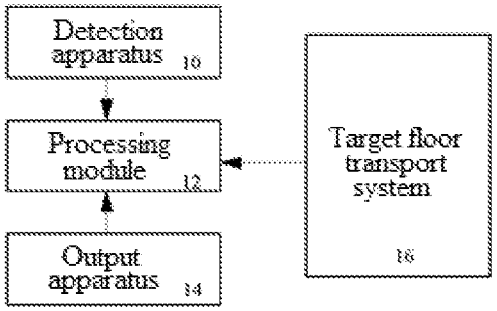
FIG. 1 is a schematic structural diagram of an elevator taking user management system according to an example of the present invention.

Schematic examples of the present invention are described now with reference to the accompanying drawings, and the same reference numerals present the same elements. Embodiments described in the following are advantageous for persons skilled in the art to understand the present invention thoroughly, and they are intended to be exemplary instead of limiting. Graphics of elements, components, units and apparatuses in the drawings are not necessarily drawn in proportion, and merely schematically indicate relative relations between the elements, components, modules and apparatuses.

The elevator mentioned in the present invention is located in a building, and a hall of the building, that is, the hall in general understanding of persons skilled in the art, is generally located at the floor of the building on the ground; however, it may also be located at another floor of the building. An elevator taking user refers to a person entering the building and intending to take the elevator.

In this text, a target floor transport system is known by persons skilled in the art. In brief, the target floor transport system provides a target floor input device at each floor of the building, the user inputs, through the input device, a target floor to which the user intends to arrive, and the target floor transport system performs allocating on the elevator according to the input of the user.

In the example of the following, A being "electrically connected" to B may be A being connected to B through a wire, a cable, an optical fiber and the like, and may also be a wireless communication connection between A and B by means of a wireless signal. Here, A and B may be components, elements, units, modules, or the like.

FIG. 1 is a schematic structural diagram of an elevator taking user management system according to an example of the present invention. As shown in the drawing, the elevator taking user management system includes a detection apparatus 10, a processing module 12, and an output apparatus 14. The processing module 12 is respectively electrically connected to the detection apparatus 10 and the output apparatus 14. At the same time, the processing module 12 is further electrically connected to the target floor transport system of the elevator.

The detection apparatus 10 may adopt an image capturing device, for example, a camera adopted in a regular security system, and other elements capable of performing detection may also be used, such as an infrared sensor. The detection apparatus 10 is mounted at a position where the number of persons in an elevator waiting area may be detected, so as to detect the number of persons in the elevator waiting area. Persons skilled in the art may understand that specific division of the elevator waiting area may vary according to different arrangements in specific buildings. The processing module 12 receives a signal at least indicating the detected number of persons sent by the detection apparatus 10, and the processing module 12 further acquires, from the target floor transport system 16, the number of persons who have input target floors in persons waiting for the elevator at the floor where the detection apparatus 10 is located. The number of persons who have input target floors acquired from the target floor transport system 16 refers to the number of persons who have input, through the input terminal of the target floor transport system, floors to which they intend to arrive. Further, the processing module 12 compares the number of persons detected by the detection apparatus 10 with the number of persons acquired by the target floor transport system 16, so as to know whether all the persons waiting at the floor where the detection apparatus 10 is located have input target floors. When a comparison result shows that the number of persons waiting at the floor where the detection apparatus 10 is located is greater than the number of persons who input target floors, the processing module 12 may send a reminding signal to the output apparatus 14. The output apparatus 14 presents the reminding signal at the elevator waiting area, so as to prompt those who do not input target floors to input target floors.

As an example, the processing module 12 may be, for example, implemented in an existing electronic system related to the elevator, such as, a security system of the elevator, or a target floor transport system of the elevator. The processing module 12 may be implemented in the form of software, and may also be implemented in the form of hardware, or be implemented by combining software and hardware.

According to an example of the present invention, the output apparatus 12 is a display apparatus, such as a liquid crystal display. The display apparatus presents in real time the signal sent by the processing module 12 at the elevator waiting area. For example, the signal may be presented in the form of text, or presented in the form of combining text and an image or a video, or presented in the form of an image or a video.

According to another example of the present invention, the output apparatus 12 is a voice prompt apparatus, which presents the reminding signal from the processing module 12 in a voice manner at the elevator waiting area being detected by the detection apparatus 10. In this manner, the presentation may be performed by playing a voice prompt every a certain period of time.

As an example, the reminding may be performed by using voice in combination with displaying. Other manners capable of achieving the reminding those who wait for the elevator to input target floors all fall within the scope of the present invention.

In various examples of the present invention, there may be various detection apparatuses 10, respectively disposed at every floor or some floors in the elevator arrival floors. In this case, optionally, the output apparatus is disposed at every floor where the detection apparatus is disposed.

By comparing the detected actual number of persons and the number of persons who input target floors, those who do not input target floors are reminded to input target floors. Therefore, more or even all elevator waiting persons may be prompted to input target floors, thereby facilitating allocating the elevator more accurately.

The present invention is described in the following through specific examples. In the specific example, the detection apparatus 10 is a camera (in this example, the reference numeral 10 of the detection apparatus is directly used).

The camera 10 may be disposed at a position where the elevator waiting area can be detected at a floor A (the floor A may be any floor in the elevator arrival floors). The position of the camera 10 may be disposed according to actual situations. In addition, the camera 10 adopts an existing image capturing apparatus disposed at the hall or each floor (if any) in a security system. The processing module 12 may be, for example, implemented in an existing electronic system related to the elevator, such as, a security system of the elevator, or a target floor transport system of the elevator.

The processing module 12 receives a signal sent by the camera 10, so as to know how many persons are waiting for the elevator. The processing module 12 acquires, from the target floor transport system 16, how many persons have input target floors through the input terminal of the target floor transport system 16 in the hall. In the case that the acquired detected number of persons is greater than the number of persons who input target floors, a reminding signal is sent to, for example, the display apparatus disposed at the floor A, and the display apparatus presents the reminding information, the information being, for example, "Ladies and gentlemen who do not input target floors, please input your target floors". Those who view the reminding information and do not input target floors are therefore reminded to input target floors.

It is assumed that the number of persons waiting for the elevator at the floor A is 20, and the number of persons who input target floors through the input terminal of the target floor transport system 16 disposed at the floor A is 8. In the case of not implementing the technical solution of the present invention, the target floor transport system 16 only allocates one elevator (the calibrated number of persons of this elevator is 10) according to that there are only 8 persons at the floor A need to leave for a certain floor or certain floors, and therefore, some persons cannot take the elevator. In the case of implementing the technical solution of the present invention, the 12 persons who are waiting for the elevator and do not input target floors may input target floors after viewing the reminding information, and the target floor transport system 16 accordingly allocates the appropriate number of elevators downwards, thereby improving the efficiency of elevator allocation.

Moreover, for a user who calls the elevator by using the input terminal of the target floor transport system 16 for the first time, the technical solution shown in the present invention can definitely remind or tell him/her how to use it.

According to the present invention, an elevator system is further provided, which includes the elevator taking user management system as described in the foregoing.

Figure 2:
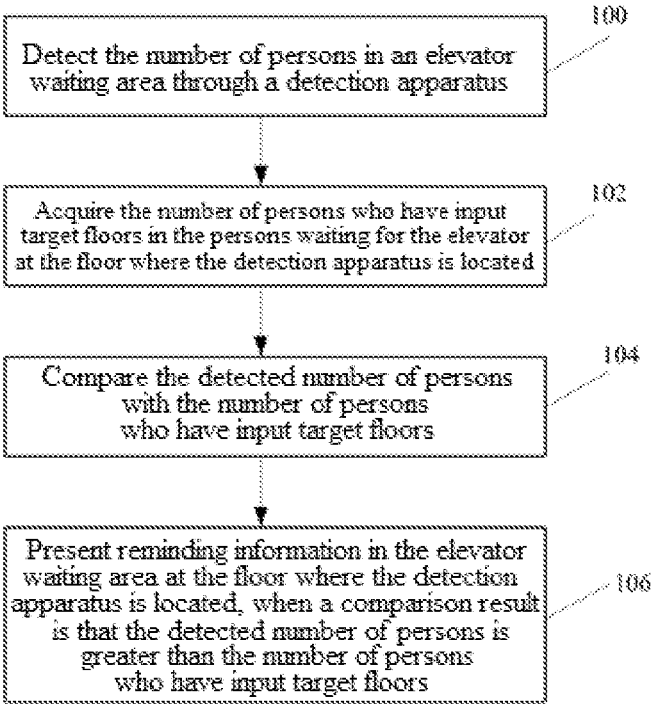
FIG. 2 is a flow chart of an elevator taking user management method according to another example of the present invention.

FIG. 2 is a flow chart of an elevator taking user management method according to another example of the present invention. As shown in the drawing, in step 100, a detection apparatus is used to detect the number of persons in an elevator waiting area. The detection apparatus may be an image capturing device, for example, a camera, and other elements capable of performing detection may also be used, such as an infrared sensor. The detection apparatus is mounted at a position where the number of persons at an elevator waiting area may be detected, so as to detect the number of persons at the elevator waiting area.

In step 102, the number of persons who have input target floors at the floor where the detection apparatus is located is acquired from a target floor transport system of the elevator. The number of persons who have input target floors acquired from the target floor transport system refers to the number of persons who have input, through an input terminal of the target floor transport system, floors to which they intend to arrive.

In step 104, the detected number of persons is compared with the number of persons who have input target floors, so as to know whether all persons waiting for the elevator at the floor where the detection apparatus is located have input target floors.

In step 106, when a comparison result of step 104 is that the detected number of persons is greater than the number of persons who have input target floors, reminding information is presented in the elevator waiting area of the floor where the detection apparatus is located, so as to remind those who do not input target floors to input target floors.

As an example, in the step 106, the presenting the reminding information in the elevator waiting area is presenting the reminding signal from the processing module in real time in a displaying manner in the elevator waiting area being detected by the detection apparatus. More specifically, the reminding information is displayed in real time through a display, the reminding information may be text, or a combination of text and an image or a video, or an image or a video. Alternatively, the output apparatus may be a voice prompt apparatus, which presents the reminding information in a voice manner; in this manner, the presentation may be performed by playing a voice prompt every a certain period of time.

Moreover, in this example, the detection apparatus is disposed at the floors to which the elevator arrives, that is at every floor or some floors in the elevator arrival floors. In this case, optionally, the output apparatus is disposed at every floor where the detection apparatus is disposed.

According to an example of the present invention, an elevator management method is further provided. The method includes the elevator taking user management method as described in the foregoing.

The specific embodiments of the present invention have been disclosed in the foregoing descriptions in combination with the accompanying drawings; however, persons skilled in the art may understand that variations or modifications can be made on the disclosed specific embodiments without departing from the spirit of the present invention. The embodiments of the present invention are merely used for schematically illustrating instead of limiting the present invention.

The invention claimed is:

1. An elevator taking user management system, comprising:

a detection apparatus, for detecting the number of persons in an elevator waiting area;

a processing module, electrically connected to the detection apparatus and a target floor transport system of the elevator, wherein the processing module is used for receiving a signal at least indicating the detected number of persons sent by the detection apparatus, and acquiring the number of persons who have input target floors from the target floor transport system, and the processing module compares the detected number of persons with the number of persons who have input target floors at the floor where the detection apparatus is located, and when the detected number of persons is greater than the number of persons who have input target floors, sends a reminding signal; and an output apparatus, electrically connected to the processing module, for receiving the reminding signal and presenting the reminding signal in the elevator waiting area, so as to remind those who do not input target floors to input the target floors.

2. The elevator taking user management system according to claim 1, wherein, the output apparatus is a display apparatus, which displays the reminding signal from the processing module in real time in the elevator waiting area being detected by the detection apparatus.

3. The elevator taking user management system according to claim 1, wherein, the output apparatus is a voice prompt apparatus, which presents the reminding signal from the processing module in a voice manner in the elevator waiting area being detected by the detection apparatus.

4. The elevator taking user management system according to claim 1, wherein the detection apparatus is disposed in a hall of a building where the elevator is located.

5. The elevator taking user management system according to claim 1, wherein the detection apparatus is disposed respectively at every floor or some floors of elevator arrival floors.

6. The elevator taking user management system according to claim 5, wherein the output apparatus is disposed at the arrival floor provided with the detection apparatus in the elevator arrival floors.

7. An elevator system, comprising the elevator taking user management system according to claim 1.

8. An elevator taking user management method, comprising:

detecting, by a detection apparatus, the number of persons in an elevator waiting area;

acquiring, by a target floor transport system of the elevator, the number of persons who have input target floors at a floor where the detection apparatus is located; and comparing the detected number of persons with the number of persons who have input target floors, and presenting reminding information in the elevator waiting area being detected by the detection apparatus when the detected number of persons is greater than the number of persons who have input target floors, so as to remind those who do not input target floors to input target floors.

9. The elevator taking user management method according to claim 8, wherein, the presenting the reminding information in the elevator waiting area is presenting the reminding signal from the processing module in real time in a displaying manner in the elevator waiting area being detected by the detection apparatus.

10. The elevator taking user management method according to claim 8, wherein, the presenting the reminding information in the elevator waiting area is presenting the reminding signal from the processing module in a voice manner in the elevator waiting area being detected by the detection apparatus.

11. The elevator taking user management method according to claim 8, wherein the detection apparatus is disposed in a hall of a building where the elevator is located.

12. The elevator taking user management method according to claim 8, wherein the detection apparatus is disposed at every floor or some floors of elevator arrival floors.

13. The elevator taking user management method according to claim 12, wherein the output apparatus is disposed at the arrival floor provided with the detection apparatus in the elevator arrival floors.

14. An elevator management method, comprising the elevator taking user management method according to claim 8.

* * * * *